US006148870A

United States Patent [19]

Lindblom

[11] Patent Number: 6,148,870

[45] Date of Patent: Nov. 21, 2000

[54] TUBULAR FABRIC WEAVING MACHINE WITH TURNOVER FOLD CONTROL

[75] Inventor: Bo Lindblom, Osby, Sweden

[73] Assignee: Texo AB, Almhult, Sweden

[21] Appl. No.: 09/336,771

[22] Filed: Jun. 21, 1999

[30] Foreign Application Priority Data

Aug. 31, 1998 [SE] Sweden ..... 9802915

[51] Int. Cl.[7] ..... D21F 1/00; D03D 47/00

[52] U.S. Cl. ..... 139/383 AA; 139/1 R; 139/11

[58] Field of Search ..... 139/1 R, 388, 139/383 AA, 438, 11; 428/57; 162/904; 442/206

[56] References Cited

U.S. PATENT DOCUMENTS

| | | | |
|---|---|---|---|
| 1,513,506 | 10/1924 | Holt et al. . | |
| 2,903,021 | 9/1959 | Holden et al. . | |
| 3,727,647 | 4/1973 | Laval | 139/438 |
| 4,410,015 | 10/1983 | Koller et al. . | |
| 4,658,863 | 4/1987 | Errecart . | |
| 4,771,814 | 9/1988 | Quigley . | |
| 5,360,038 | 11/1994 | Sano . | |
| 5,411,063 | 5/1995 | Hacker et al. . | |

FOREIGN PATENT DOCUMENTS

| | | |
|---|---|---|
| 0236601 | 9/1987 | European Pat. Off. . |
| 0502635 | 9/1992 | European Pat. Off. . |
| 0597495 | 5/1994 | European Pat. Off. . |
| 1066975 | 4/1967 | United Kingdom . |

*Primary Examiner*—Andy Falik
*Attorney, Agent, or Firm*—Pollock Vande Sande & Amernick, R.L.L.P.

[57] ABSTRACT

A weaving machine arrangement incorporates a shaft frame machine and, arranged on both sides thereof, two Jacquard machines. The weaving machine arrangement is coordinated, and first warp threads for the woven material are obtained from the shaft frame weaving machine and second warp threads from the Jacquard machines. The second warp threads are used to form spread-out turnover fold areas in the tubular material. The Jacquard machines form patterns for the closing locations of the weft threads in the turnover fold areas. By using spread-out turnover fold areas and spreading the closing locations of the weft threads in these areas, high-strength piecing functions are obtained in the tubular weave.

22 Claims, 11 Drawing Sheets

TUBULAR FABRIC WEAVING MACHINE WITH TURNOVER FOLD CONTROL

Weaving machine arrangement with method, device and application and tubular product produced with the arrangement.

TECHNICAL FIELD

The following invention relates to a method for, by means of a weaving machine arrangement comprising a shaft machine, enabling the production of a tubular product, for example forming wire, and comprising top and bottom plies and turnover fold areas, and in which weft threads can be guided in sheds formed with warp threads. The invention also relates to a device for use in a weaving machine arrangement for a tubular product comprising top and bottom plies which can be pieced together by way of a piecing area or turnover fold area and which are realized by means of weft and warp threads in which the weft threads can be guided through leases formed with the warp threads. The invention additionally relates to a tubular weave achieved in a weaving machine arrangement by means of warp and weft threads and comprising top and bottom plies united by piecing area(s) or turnover fold area(s). The invention relates to an arrangement which allows an increased level of automation in weaving and at the same time achieves high strength in respect of a turnover fold on top part and bottom part materials (cloths, felts, wires, etc.) which are woven by means of the weaving machine arrangement. The shaft machine can operate with first warp threads and draw-in threads in which the respective draw-in thread is guided in the transverse direction of the first warp threads through a shed formed by the first warp threads and is gripped by gripping members and cut off at its ends in its drawn-in location. The invention also relates to a device for use in a weaving machine arrangement, to enable an increased level of automation and strength in a turnover fold for said top the bottom weave materials. The shaft machine herein operates with first warp threads and draw-in threads in which the respective draw-in thread can be actuated by means of grippers. The draw-in threads can be cut off at their ends in their guided-in locations. The invention also relates to an application in respect of a shaft machine, in which the top and bottom weave materials can be produced using first warp threads and draw-in threads which can be drawn through in sheds formed with the warp threads and can be cut off at their respective ends. Gripping members can herein be used to capture the respective weft thread.

BACKGROUND OF THE INVENTION

It is previously known to weave tubular weave in shaft frame machines which operate with a spool shuttle for drawing the draw-in thread through a shed formed with the warp threads. It is also previously known to weave flat-woven material which is removed from the machine and subsequently folded and pieced together at its free ends. The weave thus extends in the longitudinal direction of the warp threads and the tubular weave is established by piecing together the free ends of the warp threads. The joining has been carried out in the sewing department. The joining work takes place in a piecing area spread out in the longitudinal direction of the warp threads and it is known to distribute the exit positions of the warp thread ends in the piecing area so that a strong joint is obtained. With known equipment, the weaving of the flat-woven cloth is conducted in a weaving machine, which can be mounted in a weaving room. The joining or bringing-together of the warp thread ends is carried out in a sewing room, to which the woven material is transferred. In connection herewith, a stretching machine is used in known manner to heat-treat and stretch up the weave to allow the joining work. The joining work carried out in the sewing department has in itself partially been automated so that parts of the joining work could be carried out using a Jacquard machine. The known processes require however that the stretching machine function must be used on two separate occasions.

There is a need to increase the level of automation in tubular weave production while maintaining high strength in the turnover fold area. There is thus, for example, a desire for the whole or parts of the work in the sewing room to be eliminated, at the same time as the automated weave production enables the woven tubular weave to exhibit essentially the same strength around the whole circumference. The object of the invention is to solve, among other things, this problem.

The use of tubular weaving with a spool shuttle leads to quality problems, since the tensile stress in the weft threads cannot be kept even and appropriate, which means varying tensile effects upon the outer warp threads. The invention solves this problem by indicating a new path within the technique. Instead of carrying out the piecing function on the warp thread ends, this is carried out on the weft thread ends.

There is a definite wish for the new facilities to be implementable with tried and tested technique and not to require over-extensive conversion and design modification to the structures of existing shaft frame weaving machines. This problem too is solved by this invention.

SUMMARY OF THE INVENTION

According to the inventive concept, in respect of a respective turnover fold in the tubular weave, a relatively extended turnover fold area extending transversely across the warp threads can be maintained and the closing locations for the weft threads separated such that weaknesses do not appear in the joint. This problem too is solved by the invention.

According to the inventive concept, the closing locations are treated as a pattern which can be chosen with existing program controls (punch card control systems) to give optimal or adequate strength in the turnover fold joint. This problem too is solved by the invention in a technically simple manner.

Earlier methods, devices and applications have resulted in the stretching machine function having to be used twice, once before the joining work to stabilize the joinable warp thread ends and once after to gain an inspection of the executed joining work. There is a need to reduce the use of the stretching machine arrangement, since its use involves a complicated application function. This problem is solved by the invention.

The adjustment work relating to the automation in the sewing department is extensive and can only be carried out on long tubular weaves. There is a need to be able to simplify production in respect of tubular weaves in small series. This problem is solved by the invention.

According to the inventive concept, a shaft frame weaving machine with grippers for draw-in thread, which is known, is supplemented by a weaving machine or weaving machines for patterning the weave, for example Jacquard machines. There is here a need for optimally arranged machines, warp thread arrangements, lease functions and draw-in thread arrangements such that a technically perfect weaving product is obtained. This problem too is solved by the invention.

There is a problem with obtaining perfect controls of the weaving machine arrangement. This problem too is solved by the invention.

What can primarily be considered to be characteristic of a weaving machine arrangement according to the invention is, among other things, that the arrangement comprises firstly a shaft frame weaving machine which supplies a first lease function involving a first warp thread assembly, and secondly at least one additional machine, for example a Jacquard machine, which supplies a second lease function, coordinated with the first lease function, involving a second warp thread assembly. At a respective side or turnover fold area, cutting members for the weft threads should be arranged. The part or parts of the product realized by the respective additional machine is/are divided to form piecing areas, spread out in the longitudinal direction of the weft threads, for cut-off weft threads. At the respective turnover fold area there is/are arranged a thread-end-controlling members, which assigns to the respective cut-off weft thread end an exit position between two warp thread pairs which form part of the second warp thread assembly and in which mutually adjoining warp thread pairs may have a common warp thread. The warp thread pairs for the various weft thread ends can be chosen to give mutually displaced locations for the exit positions in the spread-out direction(s) of the respective piecing area or turnover fold area.

In a refinement of the arrangement, the thread-controlling member assigns to related weft thread end pairs belonging to two cut-off weft threads following each other in the pattern an exit position between the same warp thread pairs or between different warp thread pairs which are placed after each other viewed in the longitudinal directions of the weft threads.

Also included within this refinement is that that part of the top ply which is woven by the respective additional machine forms a piecing area or turnover fold area and that the weft-thread-end-controlling member or members is/are arranged to direct thread ends of weft threads belonging to the bottom ply such that the respective thread end part turns back from the outer warp thread or warp threads in the second warp thread assembly into the lease of the second lease function for the top ply for an exit position between warp thread pairs in the top ply. That part of the bottom ply woven by the respective additional machine can form a piecing area and the weft-thread-end-controlling member or members can further be arranged to direct thread ends of weft threads belonging to the top ply such that the respective thread end part turns back from the outer warp thread end or ends in the second warp thread assembly into the lease of the second lease function for the top ply for an exit position between warp thread pairs in the bottom ply.

In further embodiments of the inventive concept, the respective weft-thread-end-controlling member assigns to the respective weft thread an even thread tension upon the introduction of the weft thread end between its associated warp thread pair in the second warp thread assembly. Gripper or pincers functions can be arranged to cut off the respective weft thread at both its ends. The gripper function can here be arranged to form thread-end-controlling members and introduce a thread end belonging to the top and bottom ply in the second warp thread assembly in the lease for the second warp thread assembly to the particular warp thread pair in this. The gripper function can additionally be arranged to cooperate with an additional member forming the thread-end-controlling member and in one embodiment can comprise, for example, a gripper member and in another embodiment can be constituted by an air-control arrangement, etc. The additional member introduces a thread end belonging to the top or bottom ply in the second warp thread assembly in the lease for the second warp thread assembly to the particular warp thread pair in this. The respective additional machine, preferably in the form of a Jacquard machine, operates in one embodiment at double repetition rate in relation to the shaft frame machine so as, in a first lease function for the first warp thread assembly, to enable the introduction of weft thread ends for weft threads in the upper or lower ply in the lease of the lower and upper ply respectively and, in a second lease function for the upper and lower ply respectively to enable coordination of the leasing of the shaft frame weaving machine.

In one embodiment, weft thread ends in the top and bottom plies of weft thread ends which follow one another in the weave pattern can be interrelated by way of piecing threads of the same material as the weft threads. The piecing threads can be directed by means of the thread-end-controlling members in connection with the weft thread ends of the weft threads. The first ends of the piecing threads can herein be arranged in connection with the thread ends of the cut-off weft threads of the top ply and second ends can be arrangeable in connection with the thread ends of the cut-off weft threads of the bottom ply. A characteristic is that the piecing threads run around outer warp threads with even and uniform thread stretching, which is established by a gripper-controlling and thread-end-controlling arrangement.

In a device for use in a weaving machine arrangement according to the invention a piecing area extends in the longitudinal directions of the weft threads over the top and bottom ply, and a weft thread end belonging to the bottom or top ply can be guided by thread-end-controlling members around the outer warp thread or warp threads into the lease for the top and bottom plies respectively to the exit position or warp thread pair in the respective piecing area or turnover fold area.

In one embodiment, a weft thread end belonging to the top and bottom ply respectively can exit via the warp thread pair with the aid of the second lease function, which is adjustable according to the patterning.

In a method according to the invention a piecing area or turnover fold area is arranged in the longitudinal directions of the weft threads in over the top or bottom ply, and a weft thread end belonging to the bottom or top ply is guided by thread-end-controlling members around the outer warp thread or warp threads into the lease for the top and bottom plies respectively to the exit position between warp thread pairs in the respective piecing area or turnover fold area.

What can primarily be considered to be characteristic of a method according to the invention is that another machine provided to the shaft machine offers up a number of second warp threads in connection with and outside the first warp threads of the shaft frame weaving machine and that the second warp threads for forming open and closed sheds for the weft threads are actuated individually and separately in relation to the first warp threads by means of controls in or of the additional machine, and that by means of the second warp threads a turnover fold area is formed extending from the turnover fold edge and in over the respective material in the direction of the draw-in threads. A further characteristic is that, by means of the control or controls, a situation is achieved in which the closing locations of the draw-in threads in the turnover fold area vary in the longitudinal direction of the draw-in threads.

In a refinement of the inventive concept behind the new method, two additional machines with associated second warp threads are placed in connection with each side of or in front of the shaft frame weaving machine. In a further embodiment, the turnover fold area on the respective side of the shaft frame weaving machine is divided to extend in over both the top and the bottom materials. In the case of a first weft thread with a closing location slightly into the top or bottom material, the end of the first weft thread is guided up to a closing location for a second weft thread on the bottom and top material respectively after having been wrapped around the respective outer warp thread and directed between the warp threads situated outside the closing location for the first weft thread.

This refinement of the new method can also incorporate the feature that the product which has been tubular-woven in this way is mounted in a stretching machine arrangement (which can be of a known type) for heat influence, in which the thread ends are fixed by the heat (for example, 185° C.). The thread material ends are therefore integrated with surrounding thread material.

One characteristic is also that the stretching machine arrangement now needs only to be used once instead of twice, as previously was required. It should be noted that tensioning of a woven product is a complex and time-consuming procedure.

A device according to an embodiment the invention principally be considered distinguished by the fact include an additional machine arranged in or beside the shaft frame weaving machine and offers up second warp threads arranged outside the first warp threads in the shaft frame weaving machine. A further feature is that the additional machine acts individually and separately in relation to the first warp threads upon the second warp threads so as to form with these sheds for the draw-in threads. The second warp threads can form part of a turnover fold area which extends in over the respective weave in the longitudinal directions of the draw-in threads and the additional machine is arranged such that it can be actuated with a control or controls by means of which the additional machine, by means of its leases, determines different closing locations for weft thread ends in the turnover fold area.

In a preferred embodiment, an additional machine is located on each side of the warp thread arrangement of the shaft frame weaving machine to form two turnover fold areas in woven material which, in pieced-together state in the weaving machine arrangement, forms a tubular weave. In a preferred embodiment, the respective additional machine comprises a pattern-weaving machine of the Jacquard machine type, which forms a pattern of the closing locations of the draw-in threads in the respective turnover fold area. The positions of the closing locations in the turnover fold areas are chosen by means of program-controlled equipment, which randomly selects the positions of the closing locations in the turnover fold areas and/or operates with long series in which mutually adjacent closing locations, viewed in the longitudinal direction of the draw-in threads, are prevented from emerging. The respective pattern machine is herein arranged to operate with a number of bobbins which support warp threads of different qualities and the respective bobbin is assigned its own load cell for detection of warp thread tension realized in the system. The cut-off thread ends are subjected to heat influence, which results in the thread ends being integrated into the weft thread and warp thread material.

In an application according to the invention a pattern weaving machine, for example a Jacquard machine, is used to supply second warp threads located outside the first warp threads and for the draw-in threads form a lease supplementing the lease to the shaft frame weaving machine in order to form a turnover fold area extending in over the respective woven material, and in that the pattern weaving machine is also used to form a pattern for the closing locations of the draw-in threads in which these assume mutually displaced locations with a view to achieving a high-strength (and spread-out) turnover fold join.

In one embodiment of the application that a member which controls the ends of the weft threads or the ends of piecing threads is used to direct thread ends of the weft threads of the top weave material around outer warp threads into a lease realized for the weft threads of the bottom weave material to thread end positions in the bottom weave material, or vice versa, and to direct piecing thread ends to positions for the weft thread ends in the top and bottom weave materials respectively.

A product according to the invention is distinguished by the fact that the respective piecing area is spread out in the longitudinal directions of the weft threads and in that a first weft thread end of a first cut-off weft thread belonging to the top or bottom ply and a second weft thread end of a cut-off second weft thread belonging to the bottom and top ply respectively and which precedes or follows the first weft thread in the pattern of the tubular weave is assigned a common exit position or successive exit positions in the longitudinal directions of the weft threads between one and the same or successive warp thread pairs in the longitudinal directions of the weft threads, adjoining warp thread pairs being able to have a common warp thread, in the respective piecing area. Further characteristics are that the exit positions for the various weft thread ends are spread out in the spread-out direction of the piecing area in the longitudinal directions of the weft threads.

In an illustrative embodiment, the piecing area extends along parts of the top and/or bottom ply in the longitudinal directions of the weft threads. The respective cut-off weft thread in the top or bottom ply has its thread end applied in an exit position located in the piecing area or the turnover fold area of the bottom and top ply respectively and is guided and possibly threaded around or through warp threads placed outside the warp thread pair concerned.

In a further embodiment, weft threads which are guided from the top or bottom ply to positions in a piecing area on the bottom and top ply respectively are drawn with tensile stresses which give even and uniform stretchings over an outer warp thread or warp threads in the piecing area.

As a result of the invention, time gains are achieved by virtue of the fact that joining of the woven top and bottom materials via loose thread ends by manual means in the sewing department can be avoided. The increased level of automation is also achieved by the fact that the fixing of the positions of the draw-in threads does not need to be carried out manually. In tubular products of, for example, 25 meters diameter and approx. 6 meters length, the time gains can be in the order of 1–2 weeks compared with earlier manual processes for thread joining. The work in the sewing department can be eliminated. The stretching machine arrangement now needs to be used only once, since a special usage stage for stiffening of the thread ends can be eliminated. In addition, two Jacquard machines, one on each side, can be applied to or built on to an existing shaft frame weaving machine operating with grippers for the weft thread, which is conducted through into respective leases realized with the warp threads. The shaft frame weaving machine herein controls its leases and the Jacquard machines their leases, all of which leases can be coordinated for the respective draw-in thread, the pattern controls in or from the Jacquard machines determining the positions for the drawn-in draw-in threads in the turnover fold area. Using a random pattern function in the respective Jacquard machine, a highly effective strength is achieved in the turnover fold area. A member for controlling the thread ends is used to direct weft threads or the bottom ply to a piecing area located on the bottom and top ply respectively. The arrangement herein allows even tensile stress distribution in the drawing around outer warp threads. The arrangement also allows the use of separate piecing threads between positions in the top and bottom ply.

BRIEF DESCRIPTION OF THE FIGURES

A currently proposed embodiment of an arrangement, method, device and application, and a tubular product, shall be described below with simultaneous reference to the appended drawings, in which.

DETAILED EMBODIMENT

Figure 1:
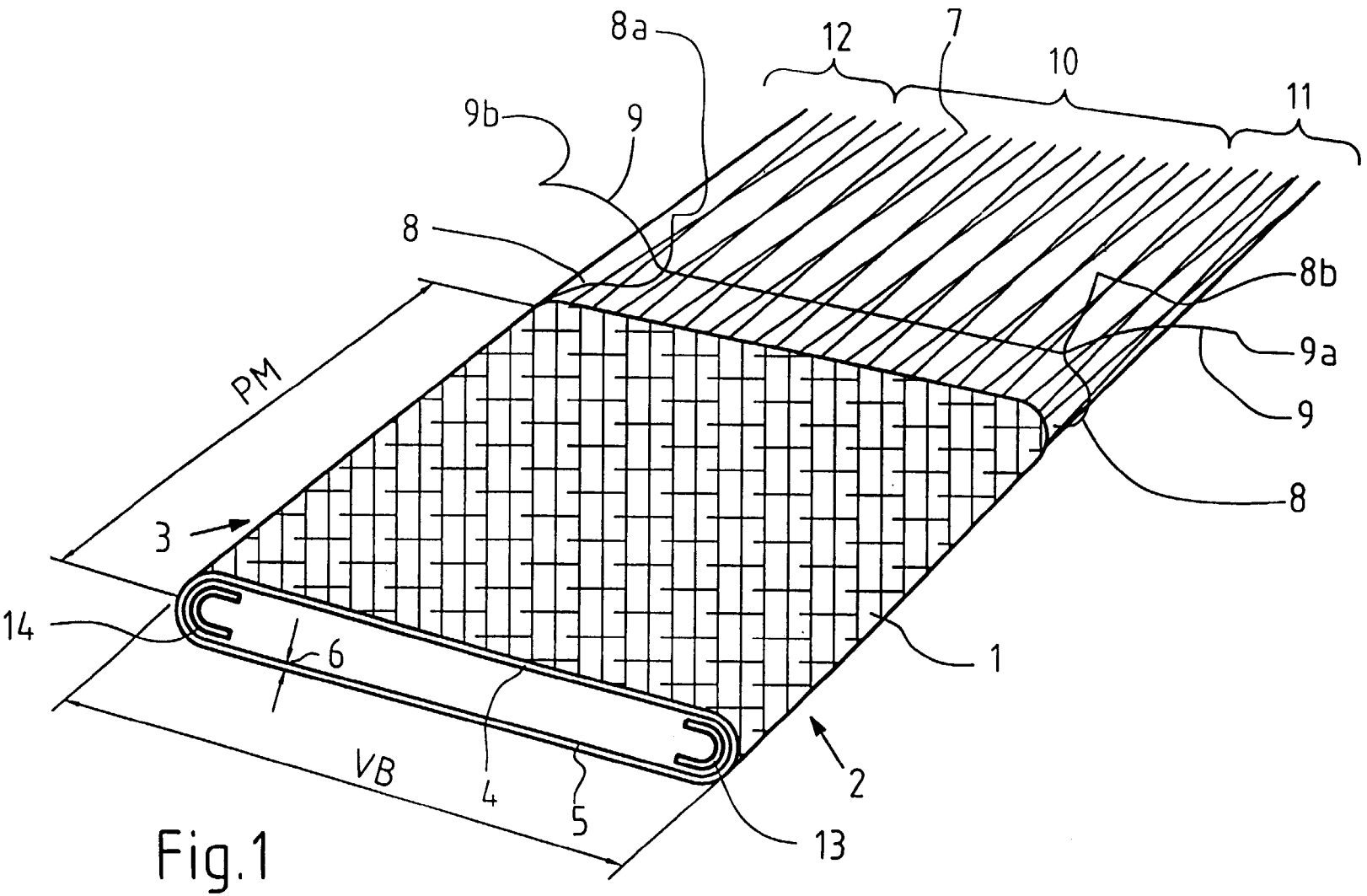
FIG. 1 shows in a view obliquely from above from the right a tubular weave during production.

In FIG. 1, a tubular product is denoted in basic representation by 1, the weaving width of the product being indicated by VB and the weaving length being indicated by PM. The invention relates first of all to the weaving of products with weaving widths of 18 meters and weaving lengths of 12 meters. The product can include tubular weave intended for use in paper-making machines. It is important for the tubular product to exhibit high quality and high strength around the whole circumference. By high strength it is here meant essentially that strength which is generated in conventional flat-weaving and joining in a sewing department. The product is woven in a shaft frame weaving machine with grippers, which means that the obtained top and bottom cloth weaves can be pieced together at the sides 2 and 3, using the weft threads in the weave.

The product 1 shown in FIG. 1, in the form of a tubular weave, is in the process of being woven. The tubular weave comprises two turnover fold areas 2, 3, which combine basically flat-woven top and bottom plies 4, 5 of a thickness 6. Each ply can consist of a double layer of warp threads lying one on top of the other and a binding thread for these as well as the weft threads. Warp threads, extending in the longitudinal direction of the product 1, are labeled 7. In a known manner, the weaving machine operates with a lease function and weft or draw-in threads, which are pushed through or drawn through a respective shed in the transverse direction of the warp threads. The weaving machine is also provided with gripper and cutting members (not shown in FIG. 1) on the respective sides. With the cutting members, the respective drawn-in or pulled-through thread is cut off at its two ends. Cut-off weft thread ends are brought together in the pattern such that the closing end of a drawn-in and cut-off thread is arranged in connection with the starting end of a following thread, etc. In FIG. 1, cut-off weft threads are indicated by 8 and 9 and the ends of the threads by 8*a*, 8*b* and 9*a*, 9*b*. In a preferred embodiment, the thread end 8*b* can be brought together with the end 9*a* of the preceding weft thread 9, etc.

In FIG. 1, the warp thread mat in the weaving machine arrangement consists of three parts. A first part 10 is obtained with a shaft frame weaving machine (not shown), which can be conventional in type. A second part 11 is obtained by a Jacquard machine (not shown) or corresponding patterning machine or patterning function. A third part 12 is obtained from a second Jacquard machine (not shown). The lease functions of the shaft frame weaving machine and Jacquard machines are coordinated such that sheds are established for the draw-in threads 8, 9 in the respective machine type. According to the invention, the warp thread parts 11 and 12 are designated for piecing site areas at the sides 2 and 3 of the woven product 1. The piecing site areas are here also referred to as turnover fold areas. Characteristic of the invention is, among other things, that the respective turnover fold area is relatively spread out. In FIG. 1, the spread of the turnover fold areas has been symbolized by bidirectional arrows 13 and 14. In the embodiment shown, the respective turnover fold area comprises approx. 450 warp threads in width when viewed radially. Each turnover fold according to FIG. 1 consists of two parts arranged one over the other, one located on the top ply and one on the bottom ply, the respective part being approx. 450 warp threads wide.

Figure 2:
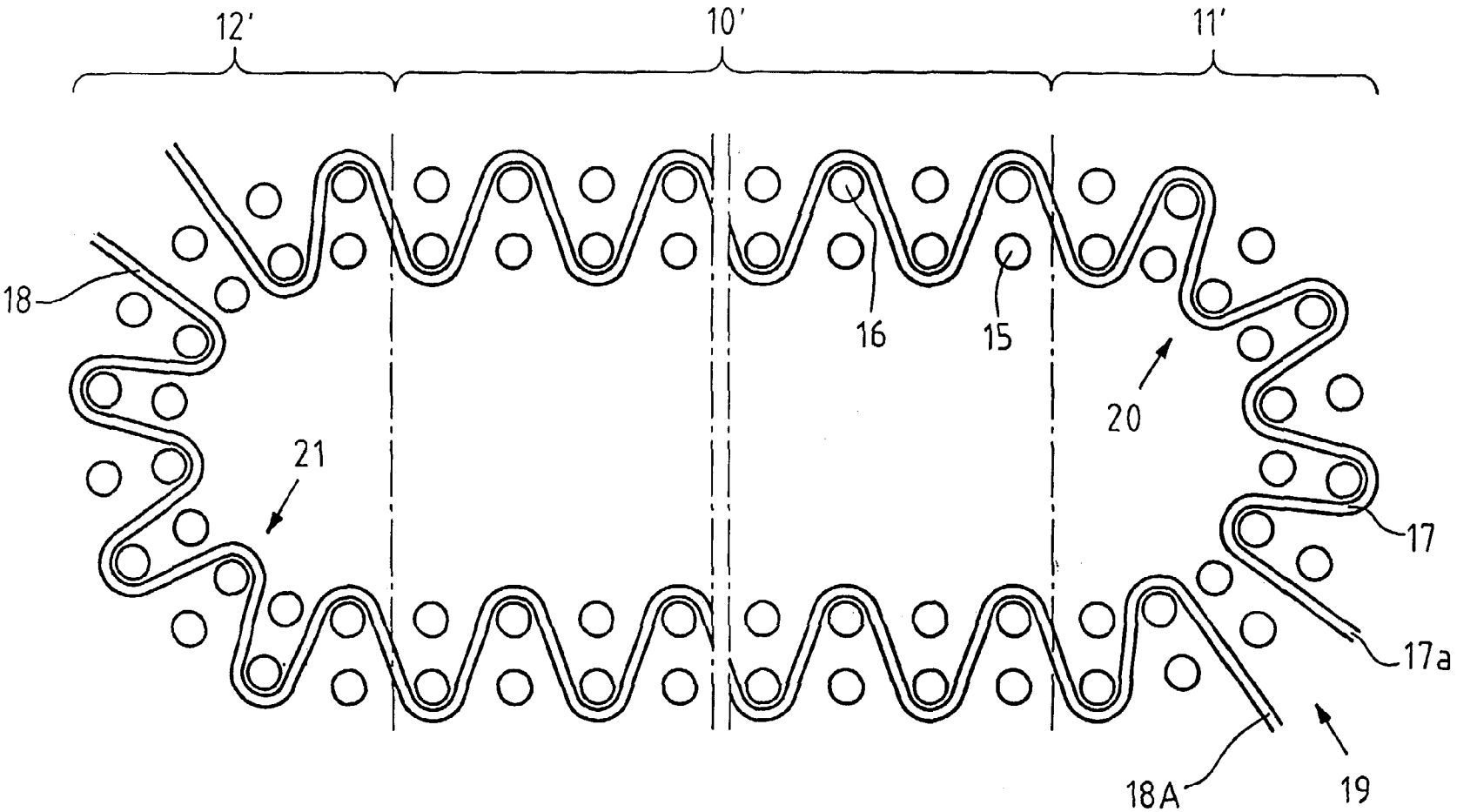
FIG. 2 shows in cross section an example of the mutual relationship between warp threads and weft threads in connection with the piecing or turnover fold areas and the basically flat-woven areas.

According to FIG. 2, in the woven product, which in the cross section shown in the longitudinal direction is composed of two warp thread layers 15 and 16, weft threads 17 and 18 shall be drawn through the shown cross section circumference. The binding thread is not shown in this example. The thread ends 17*a* and 18*a* can be brought together at a first closing position or a first changeover site 19. In FIG. 2, a changeover site or closing position for two second threads (not shown) is indicated by 20 and a changeover or closing position for two third threads is denoted by 21, etc. The changeover sites or closing positions 19, 20 and 21 are located in the turnover fold areas 11' and 12', The area 10' has no such changeover site or closing positions. The weft thread ends 17*a*, 18*a* can obtain a closing position between the same pair or successive pairs of warp threads in the tubular weave. By the term warp thread pair it is here meant the pair of warp threads in the lower or the upper layer. The respective thread end is led out through the warp thread pair of the lower layer as well as through the warp thread pair of the upper layer. In the present case, the warp thread pairs of the top and bottom ply have a common warp thread. Alternatively, the respective weft thread ends which are to be brought together or arranged in connection with each other can extend through the same warp thread pair or through widely spaced warp thread pairs. In one embodiment, the thread end parts can be drawn past each other, so-called cross-laying. In this case, the respective thread end passes the warp thread pair of the other thread end, viewed in the direction of the circumference.

Figure 3:
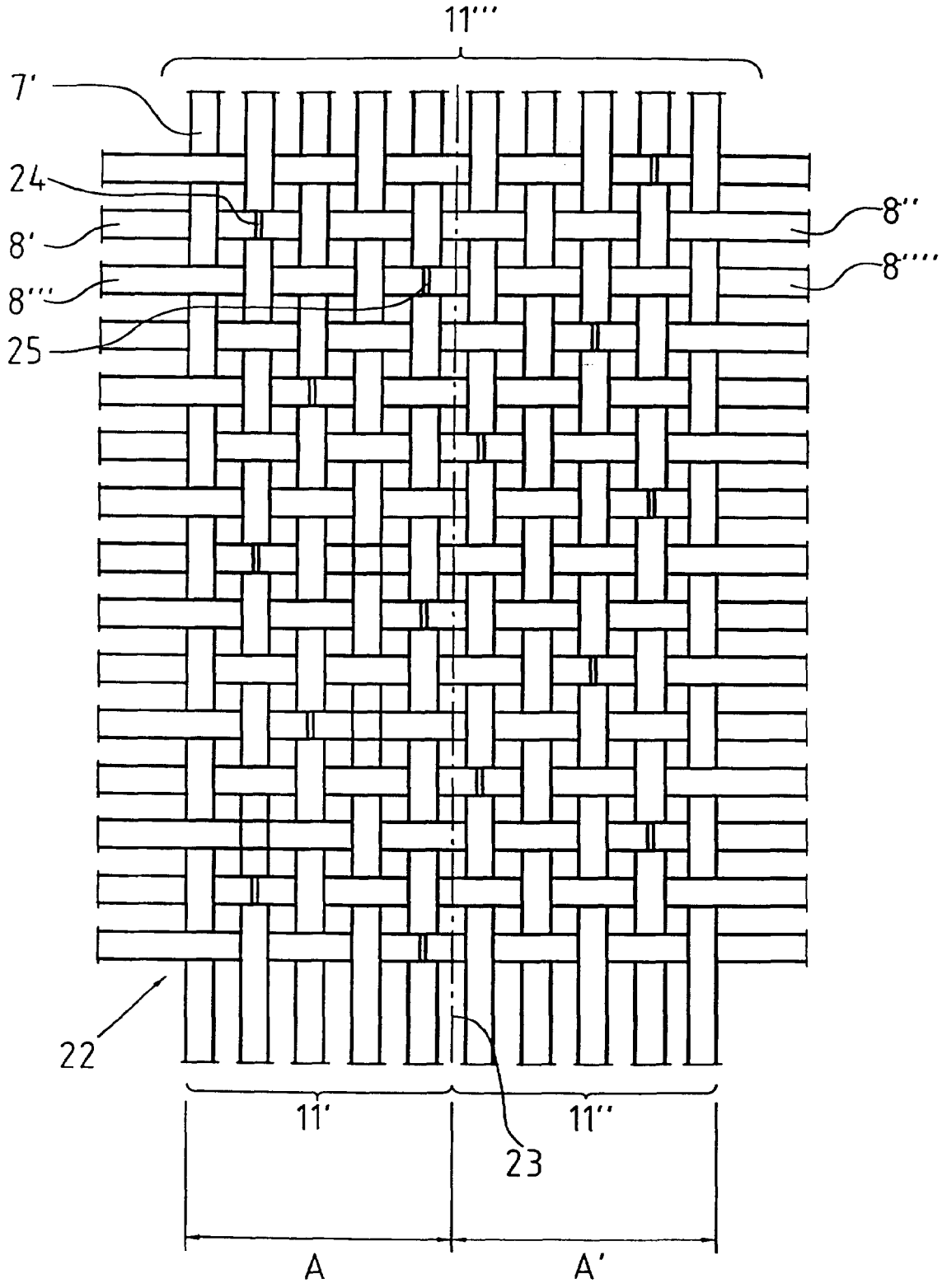
FIG. 3 shows in horizontal view parts of a turnover fold area spread out in the horizontal view.

In FIG. 3, parts 22 of a turnover fold area are shown spread out in a horizontal plane. The warp threads are denoted by 7' and the weft threads by 8', 8" and 8'", 8"", An edge line through the turnover fold area in the direction of the warp threads is indicated by 23. The turnover thread area 22 basically consists of two parts 11' and 11" lying one over the other, which are therefore, according to FIG. 1, served by a Jacquard machine. In FIG. 3, the total spread width has been indicated by 11'", The part 11' thus belongs to the top cloth and the part 11" to the bottom cloth, see also the arrows 13 in FIG. 1. In FIG. 3, the closing locations (the changeover sites) for the various brought-together or mutually approachable thread ends are also shown. A first closing location for the weft threads 8', 8" is thus denoted by 24, a second closing location for the threads 8'", 8"" by 25, etc. As can be seen from FIG. 3, some closing locations will end up at the first turnover fold part 11', belonging to the top cloth, and other closing locations at the second turnover fold 11', belonging to the bottom cloth. The fact that closing locations are not placed essentially alongside each other, for example along an edge line parallel to the line 23 in the spread-out turnover fold area, but are spread out in the spread-out turnover fold area produces high strength in the woven material in the joints on the sides 2 and 3 (see FIG. 1). From the edge line 23, the turnover fold areas extend with distances A, A' over the woven material, see above. The distances A, A' are preferably equal in size. Alternatively, only that part of the turnover fold which is located on the top or bottom side is used to embrace closing or exit positions for weft thread ends. Preferably, the turnover fold part of the top ply is used. This means that weft threads which issue from the top or bottom ply and are assigned to a closing position of the bottom and top ply respectively shall be rearranged and possibly threaded between outer warp threads. This is an essential part of the invention and is described in greater detail below.

Figure 4:
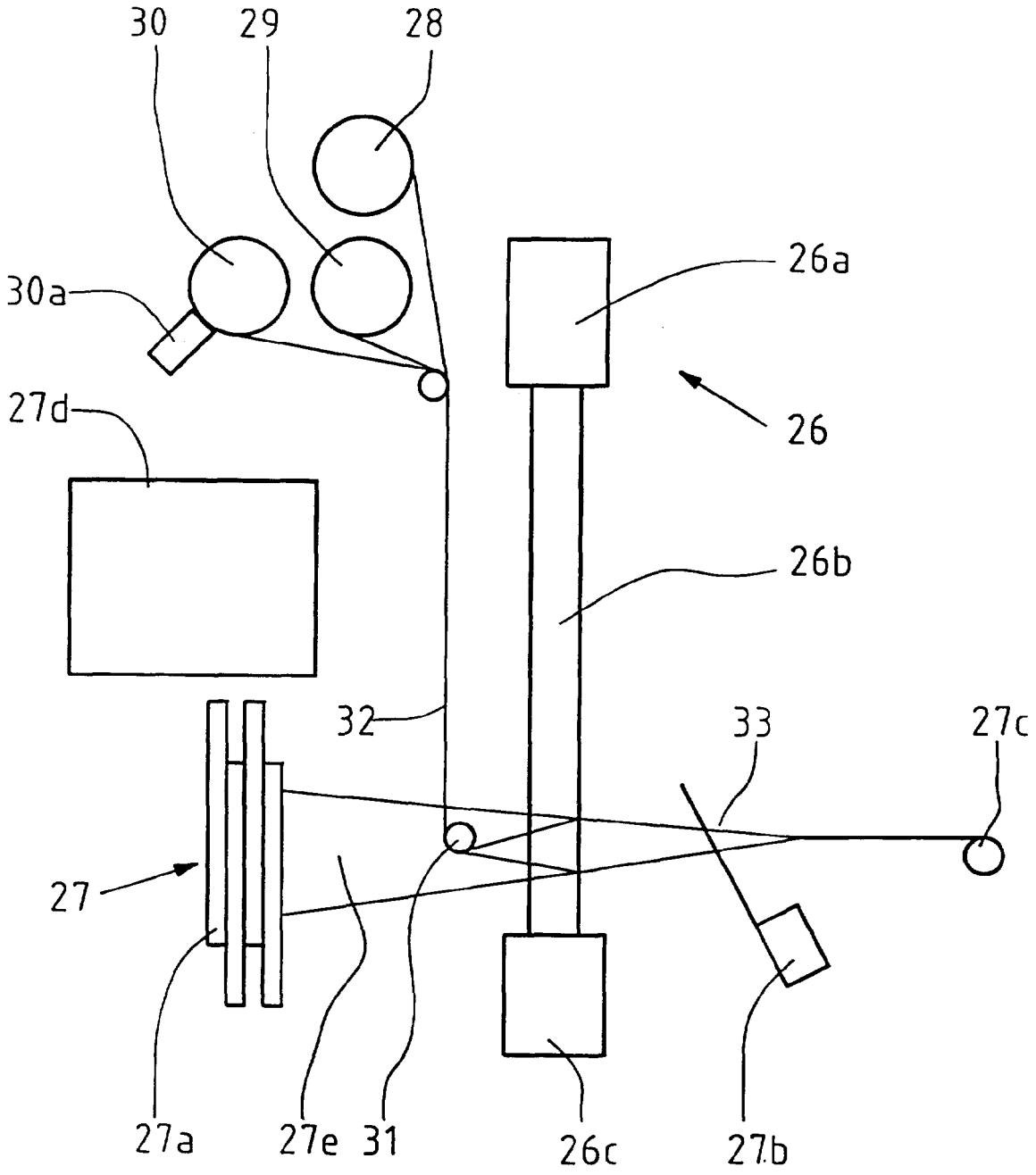
FIG. 4 shows from the side shaft frame weaving machine and Jacquard machines forming part of a weaving machine arrangement.

In a preferred embodiment, according to FIG. 4 a Jacquard machine 26 is used on each side of a shaft frame weaving machine 27 (or rather at the respective turnover fold area), which is symbolized by its shaft frames 27*a*, reed 27*b*, cloth beam 27*c* and main part 27*d*. As an example of a shaft frame weaving machine, reference is made to the TM300 machine marketed by TEXO AB, SE. Since the working of the shaft frame weaving machine is well known, it shall not here be described in further detail.

The Jacquard machine too is also known and is distinguished by the fact that it achieves patterning of woven textile material. The working method of the Jacquard machine is used in the present invention to "pattern" the above-named closing positions. By distributing the closing positions according to a certain pattern achieved by the Jacquard machine, optimal or high strengths can be achieved in a technically simple manner which, moreover, by virtue of the fact that the whole piecing process for the woven tubular wire is placed in the weaving machine arrangement, increases the level of automation. The manual thread-knotting work in the sewing department is wholly eliminated and the machine downtimes are radically reduced. The pattern can be chosen for the closing positions randomly through controlling of the Jacquard machine or according to a certain predetermined pattern which guarantees high strength. In FIG. 4, the Jacquard machine 26 is represented with main part 26*a*, from which hooks or clasps, which can be interacted with the warp threads of the Jacquard machine, hang down in cords 26*b* or equivalent. By acting upon certain of the cords, lease functions together with weight(s) 26*c* are obtained. This function is well known and shall not therefore here be described in further detail. Reference is made to the Jacquard machine "DRACUP 432×48 seaming machine" sold on the open market. The Jacquard machine is allocated three warp thread bobbins 28, 29, 30, which each represent their warp thread quality and can therefore be engaged alternately. The above-described warp thread layers in the respective ply can be constructed, for example, in varying grade of quality. Each bobbin can be provided with its own load cell function 30*a* for fixing the warp thread tension in the system. In FIG. 4, a control beam 31 for redirecting the warp threads 32 for connection to the warp thread 33 of the shaft frame weaving machine is also shown.

Figure 5:
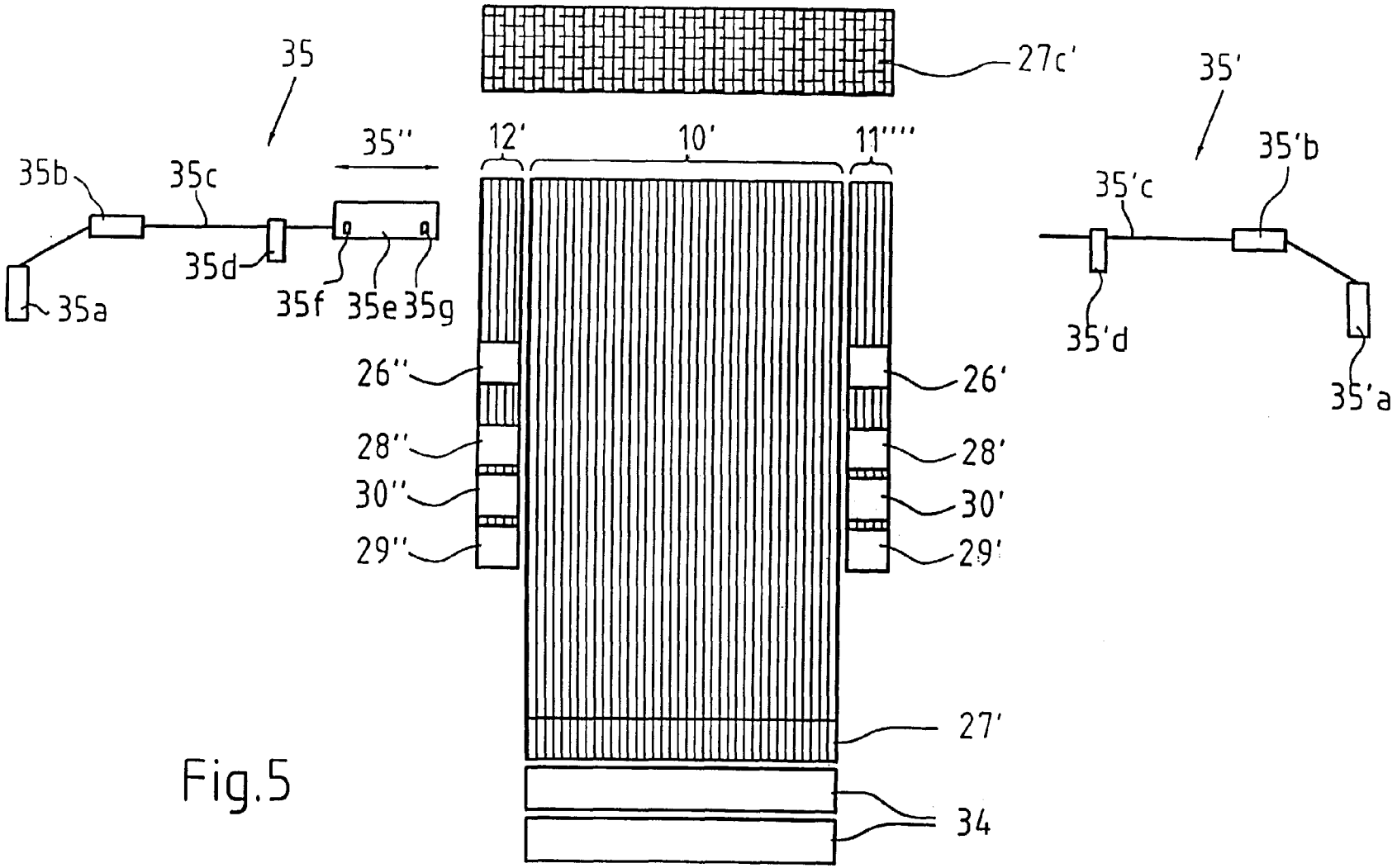
FIG. 5 shows from above parts of the weaving machine arrangement with shaft frame machine and Jacquard machines.

In FIG. 5 it is shown that a Jacquard machine 26' and 26" is respectively arranged one on each side (and somewhat in front) of the shaft frame machine 27', which offers up warp threads 10' from one or more bobbins 34 in known manner. The Jacquard machines deliver, according to the above, the warp threads 11"" and 12'. All warp threads are fed in on a joint cloth beam or a joint cloth beam system 27*c'*, The machine arrangement comprises weft-thread-realizing equipment 35, 35' on each of its sides. The respective item of equipment incorporates a spool 35*a*, 35'*a*, a feed wheel 35*b*, 35'*b*, a weft thread 35*c*, 35'*c* and a gripper 35*d*, 35'*d*. A shuttle 35*e* with pincers 35*f*, 35*g* for cutting off the weft thread takes up a present location on the one side of the arrangement. The described equipment 35, 35' is known in terms of structure and function and shall not therefore here be described in further detail. The path of direction of the shuttle is labeled 35", In connection with an exemplified structure, six grippers, three warp beams, two Jacquard machines and a spool stand for 400 threads or three bobbins can be used.

Figure 6:
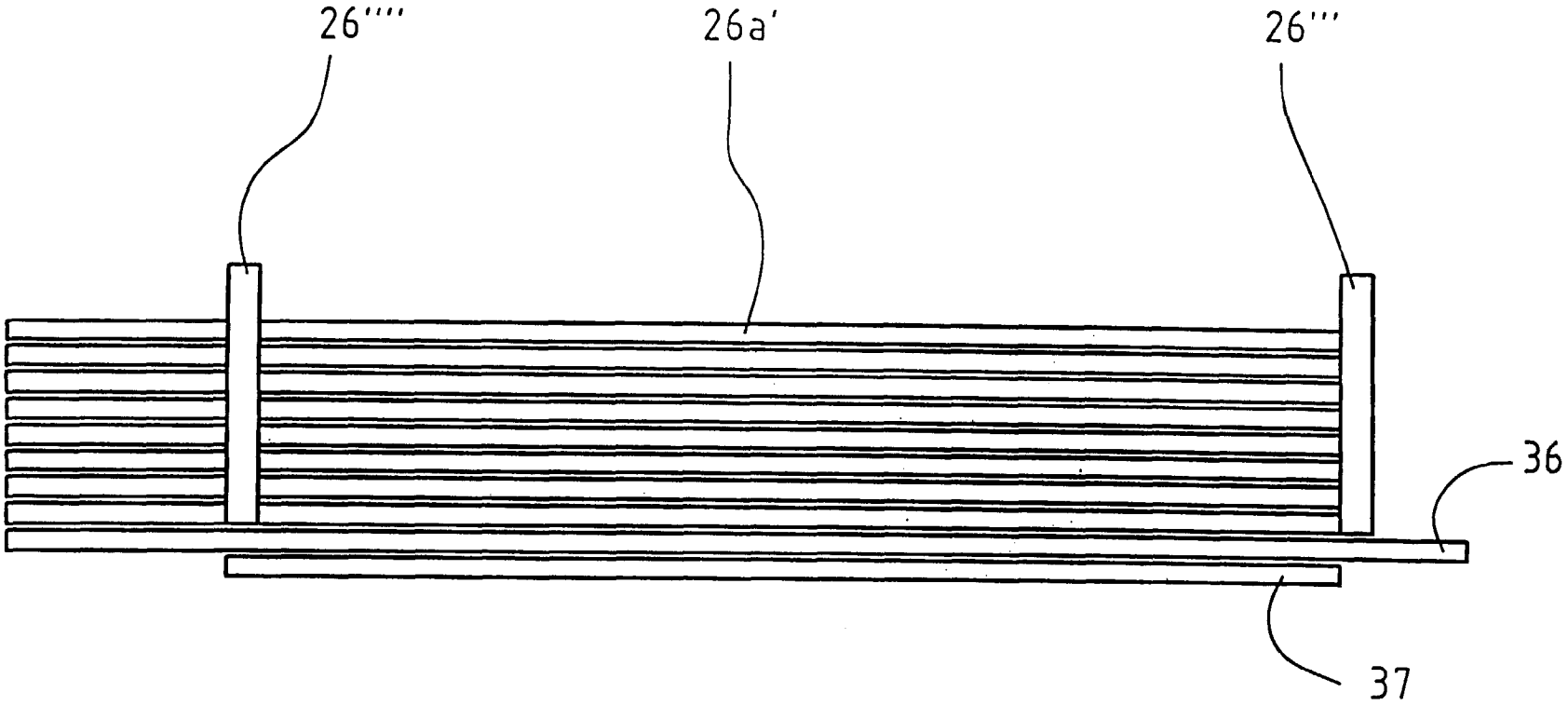
FIG. 6 shows from above the application of the Jacquard machines in connection with the shaft frames in a shaft frame machine and airbox block and internal expander.

FIG. 6 shows an example of the application of the two Jacquard machines 26'" and 26"" to shaft frames 26*a'* of the shaft frame weaving machine, which can be, for example, 24 or more in number. In addition, an airbox block or a projectile firing arrangement 36 of known type has been indicated in basic representation. Moreover, an inner expander 37, arranged in or on or by the machine, is also indicated in basic representation.

The shaft frame weaving machine and the Jacquard weaving machines therefore together form a weaving machine arrangement in which an essentially known shaft frame weaving machine is combined with essentially known Jacquard machines. The only differences which exist in relation to the known machines are the lesser matchings in the executable controls and the fact that the Jacquard machines, apart from patterning the weave, also realize a patterning of the positions for the closing locations in the turnover fold areas. Moreover, thread-redirecting members shall be provided, which guide the thread end of the weft thread in the top ply or bottom ply to a closing position in the turnover fold part of the bottom and top ply respectively.

Figure 7:
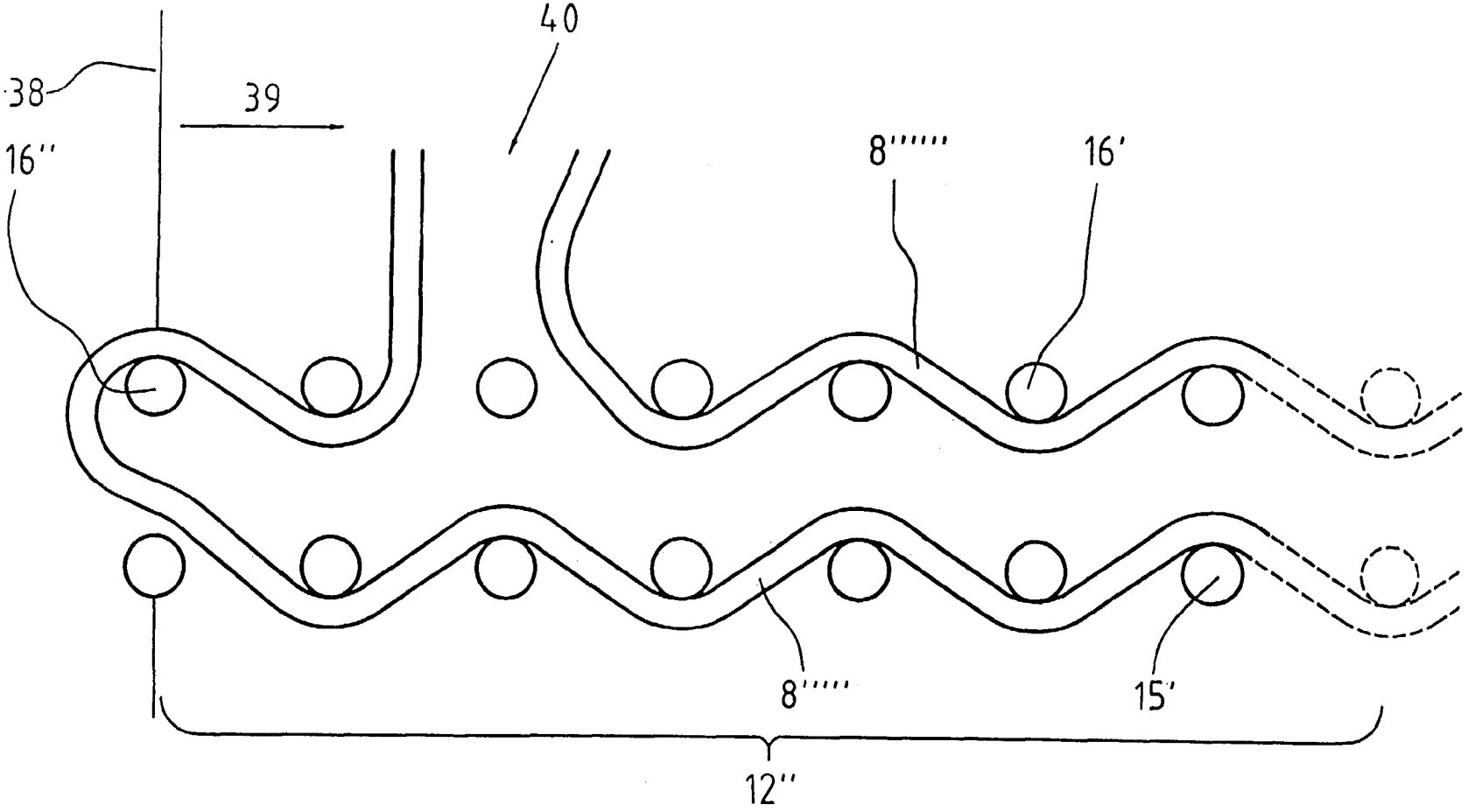
FIG. 7 shows in cross section the drawing of weft threads in the warp threads in a turnover fold area.

In order to simplify the description of the invention, FIG. 7 indicates a top and bottom ply with one layer each of warp threads and shows in basic representation a turnover fold area in which, in the bottom cloth warp 15', a weft thread 8'"" has been drawn through all the warp threads and, in the top cloth warp 16', the weft thread 8'"" has been drawn out between the third and fourth warp thread from the outer edge 38 or the outer warp thread 16", The thread is herein wrapped round the outer warp thread 16" and guided inward according to the weave pattern in the direction 39 to the joining site 40 between an inner warp thread in the joining function. This function is executed automatically in the arrangement.

Figure 8:
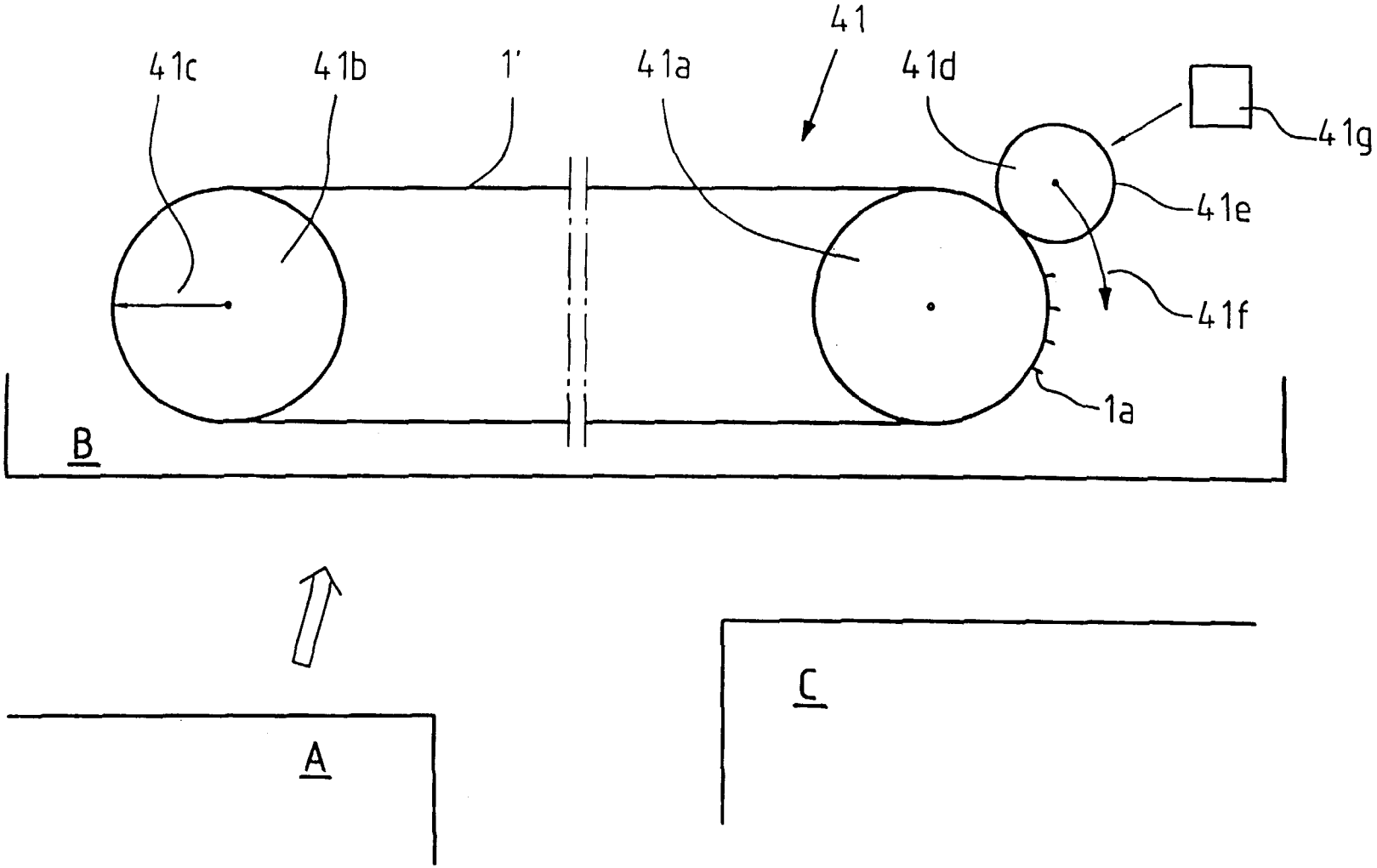
FIG. 8 shows parts of a stretching machine arrangement with heat influence members in connection with a weaving machine (weaving machine room) for tubular weave.

FIG. 8 shows in basic representation a stretching machine arrangement 41, in which a tubular weave 1' is stretched out by means of rollers 41*a*, 41*b*. The latter are mutually displaceable, see arrow 41*c*, and openable, so that the weave can be applied to and removed from the rollers. The thread fringes of the tubular wire and which are a result of the above-described thread ends projecting from warp thread pairs at closing sites are removed, for example by being cut off. At one or both rollers, a heat-supplying member 41*d* is provided. The member can be constructed as a roller having a heatable surface 41*e*. The roller member 41*d* can be rolled or guided along the periphery of the respective roller 41*a* and/or 41*b* in the direction of the arrow 41*f*. A heat-supplying member 41*g* is arranged to transfer or generate heat to the surface 41*e* of the roller 41*d*. The roller 41*d* can be pressed against the concerned roller 41*a*, 41*b* with the woven weave inbetween and therefore can interact with thread ends and surrounding material in the turnover fold area(s) (see 2, 3 in FIG. 1). The heat emission is herein chosen such that the thread material(s) receive(s) known heat influence for stiffening of the woven material. As a result of the heat influence, the thread ends are integrated with surrounding warp thread and weft thread material so that they are strengthened. Chosen temperatures can be in the order of 185° C. In an illustrative embodiment, heat transfer can be effected through contact-free heat radiation. In an illustrative embodiment, the product woven in the weaving machine arrangement can thus be introduced directly from the weaving room A to the stretching machine arrangement B without a detour via the sewing department C, thereby yielding a rationalization or automation benefit.

Figure 9:
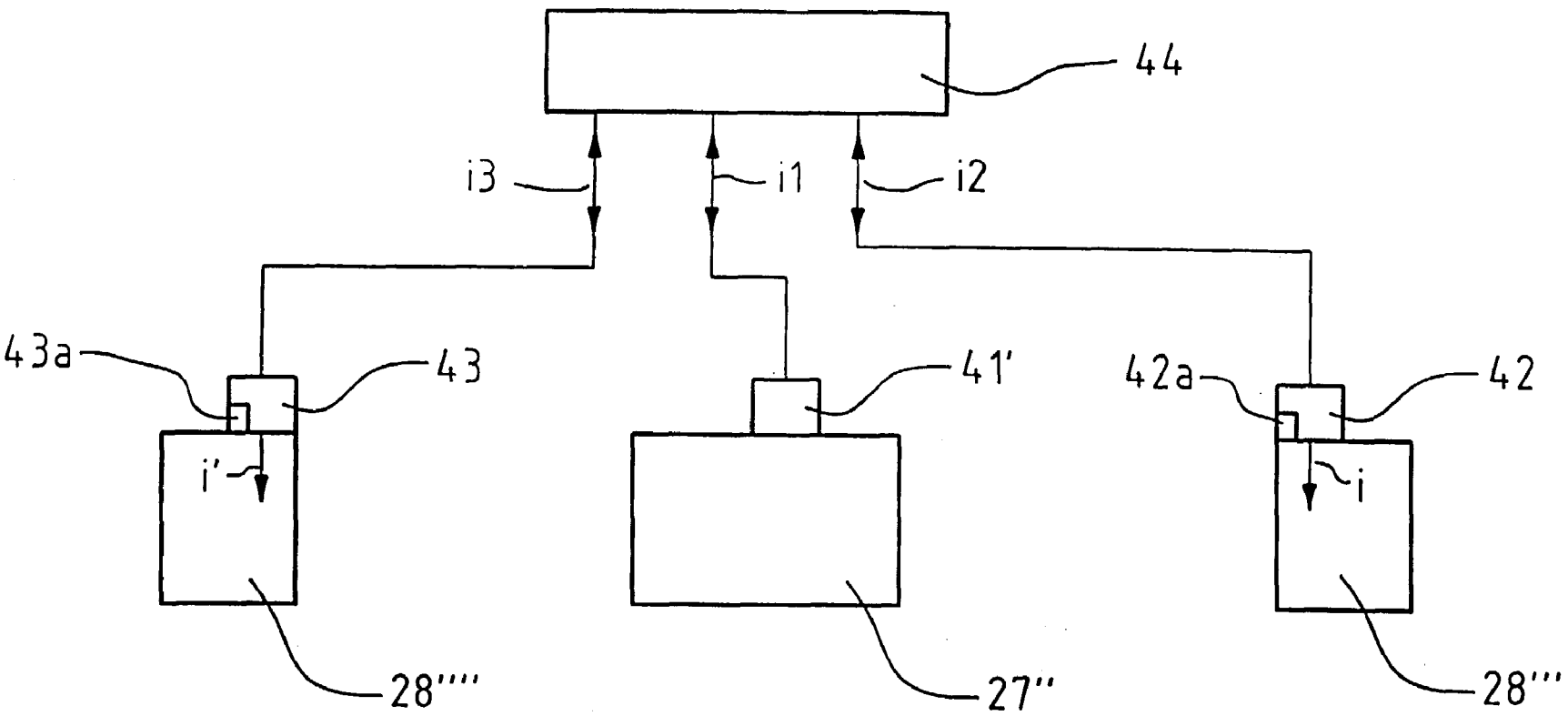
FIG. 9 shows in basic diagram form a control unit arrangement for the weaving machine arrangement.

FIG. 9 shows the control functions for the shaft frame weaving machine 27" and the Jacquard machines 28'" and 28"", The respective machine is designed with a signal control unit 41' and 42, 43 respectively, which can be controlled from an operating unit 44 for the weaving machine arrangement. The units 41', 42 and 43 can alternatively be placed in or by the unit 44. The Jacquard machines are controlled with known software in order to establish "pattern formation" for the closing locations of the weft threads and patterning of the weave in the turnover fold areas. The shaft frame weaving machine is controlled with known software for establishing the pattern for the basically flat-woven top and bottom cloths (the wires). To the pattern program of the Jacquard machine is introduced a pattern control function corresponding to the pattern control function of the shaft frame machine, such that the woven material receives the same pattern in the top and bottom parts and in the turnover fold areas. This interaction of software can be realized in known manner. The controlling of the particular pattern in the tubular weave and the setting of the pattern image for the closing locations in the turnover fold areas can be effected from the control unit 44 and/or, by way of supplementation, separately from the units 41', 42, 43. For the pattern formation of the closing positions, a random generator function, labeled 42*a* and 43*a* in FIG. 9, can be used. The patterns for the closing positions can be similar in the two turnover fold areas or can differ. The important element is that strong turnover folds are obtained in the machine arrangement. Coordination of the drives for the shaft frame weaving machines and Jacquard machines is also achieved by means of the control arrangement.

As a result of the above, a tubular forming wire is obtained, which also incorporates a gripper system. The production of the total product in the weaving machine arrangement, according to the above, yields savings of 2 weeks in the production of the forming wire, which can now be produced in a third of the time previously required. A substantially increased level of automation or level of rationalization is thus obtained and the increased level of automation is herein compared with that which is obtained when there is necessary splitting of the warp threads of the woven material at the turnover folds in the sewing department. In FIG. 4, a lease has been labeled 27*e*. This notation relates to both the lease in the shaft frame weaving machine and the leases in the Jacquard machines 26', 26", which are mutually synchronized. In FIG. 5, the grippers have been labeled 35*a* and 35*a*', In FIG. 9, the controls of the respective Jacquard machine 28'" and 28"" of the control units 42 and 43 have been labeled i and i' respectively. The control functions between the unit 44 and the units 41', 42 and 43 have been labeled i1, i2 and i3.

Figure 10:
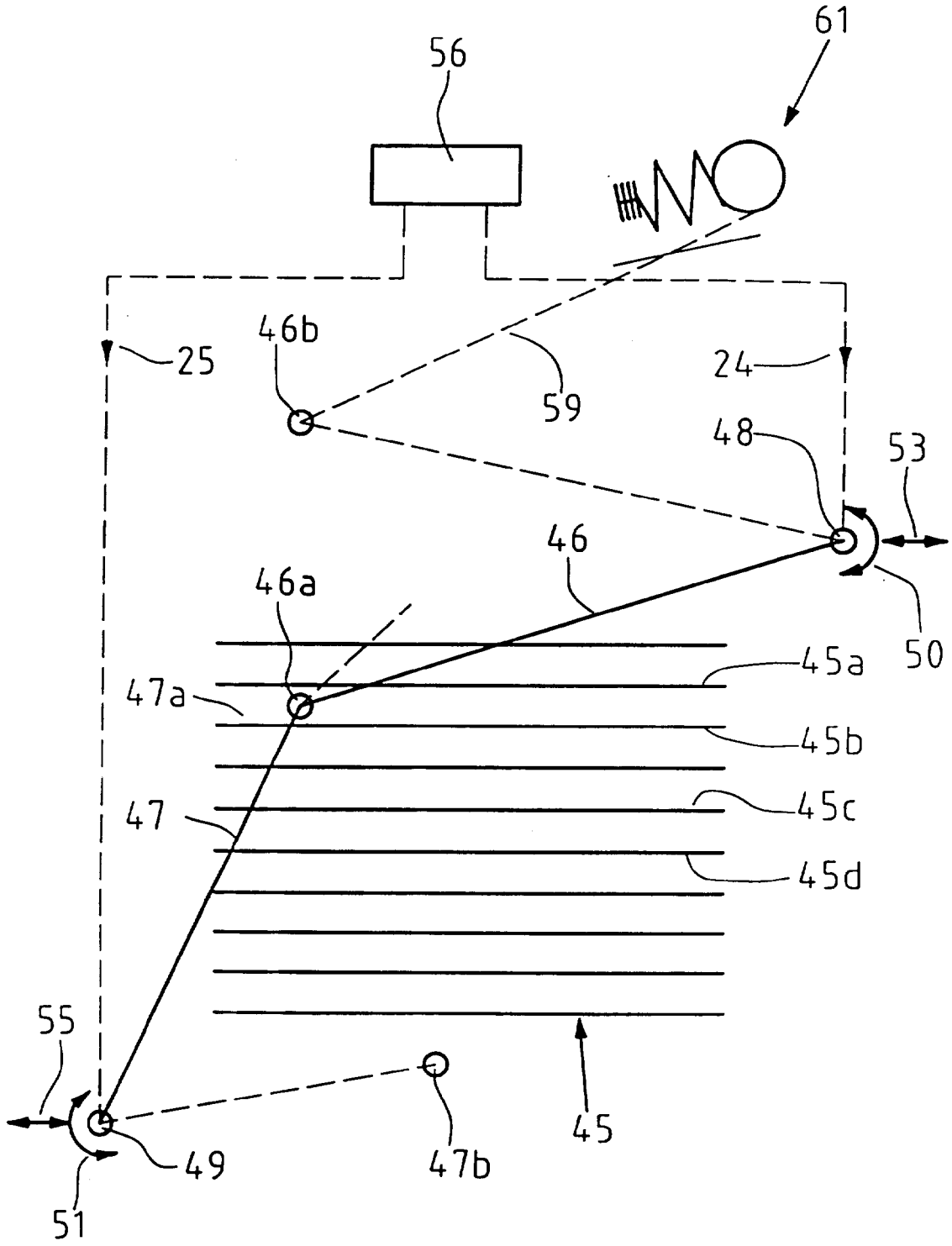
FIGS. 10 and 10*a* show in basic representation a thread-end-controlling member in horizontal and vertical views respectively.
Figure 10A:
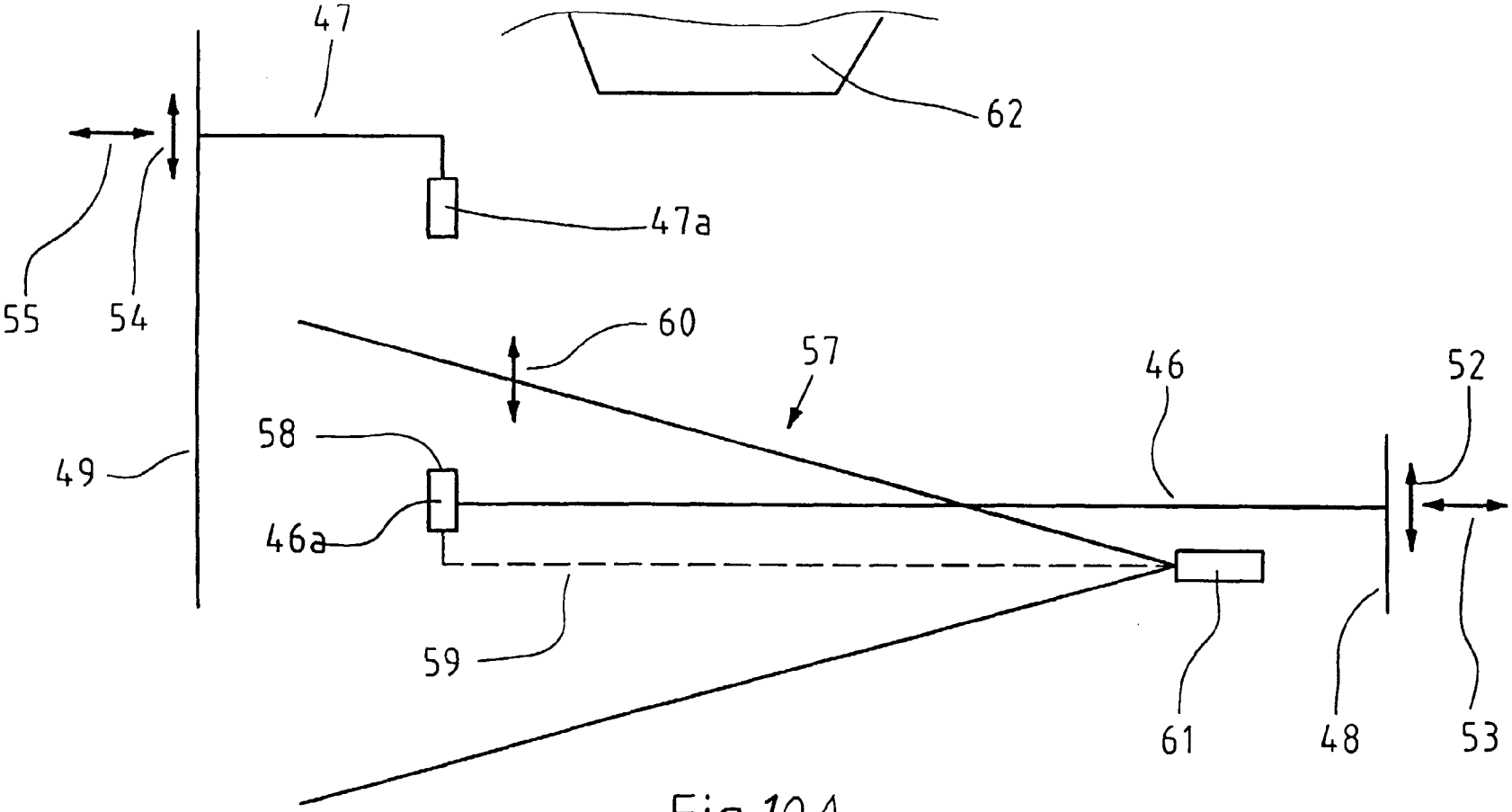

In FIGS. 10 and 10*a*, examples are shown of thread-controlling members which operate in connection with leasing for warp threads 45. In the illustrative embodiment, the members comprise two pivotable arms 46, 47. The arms can be swiveled with bearing axes 48, 49 in the directions of the arrows 50, 51. The axes 48, 49 are moreover displaceably arranged in mutually perpendicular directions 52, 53 and 54, 55 respectively. The maneuvering of the axes, i.e. the arms 46, 47, is effected from the control unit 56, which can form the control unit for the arrangement, the Jacquard machine, etc., cf. above. The swivel arms have members 46*a*, 47*a*, which are interactable with thread ends and which can be actuated to the locations represented by continuous lines in FIGS. 10, 10*a* to different locations, for example the locations represented by dashed lines 46*b*, 47*b*. The former locations are located inside the warp thread shed and the latter locations are located beside the warp threads. In the latter locations, the swivel arm 46 has captured with its member 46*a* an end 58 of a weft thread 59 and introduced it into the shed 57. In dependence upon controls or electrical control signals i4, i5, etc., the thread end can be directed into the shed and placed opposite a space between a pair of warp threads, for example the warp thread pair 45*a*, 45*b*. The swivel arms are actuated in directions 60 away from and toward each other. When the interacting members 46*a*, 47*a* are actuated such that they are mutually opposed in the vertical direction, they are activated toward each other through controlling from the unit with the signals i4, i5, etc., such that the member 47*a* can interact with the member 46*a* and, by virtue of a known take-up function, can take up the thread end from the member 46*a* and draw it up between the warp thread pair 45*a*, 45*b*, above which it releases the grip on the thread end once this has reached its final position. If this is not the case, the swivel arms can be further actuated by the unit in to the warp thread shed, for example to the space between the warp thread pair 45*c*, 45*d*, whereupon the member correspondingly takes up the thread end from the member 47, etc. until the correct/desired position has been reached for the thread end in question. The weft thread is fed in via thread-tension-determining members 62, by which a even desired tension can be maintained during the ongoing piecing process in the machine. As a supplement or alternative to the member 47, 47*a*, an air-suction arrangement 62 can be used, which can be of known type and by means of which the thread end can be sucked up between the warp threads. Warp thread drawing can thereby be realized in the one ply and the turnover fold is located in the other ply, or vice versa (cf. FIGS. 2, 3 and 7). The Jacquard machine or equivalent operates at an accelerated repetition rate such that the normal patterning of the weave can also be executed. In FIGS. 10, 10*a*, the shown arrangement can be integrated with the gripper function in the shaft frame machine.

The thread-end-controlling members are therefore designed so as, in the event of a cut-off weft thread emanating from the top ply or bottom ply being assigned a closing position for its end which is located in the turnover fold area of the respective bottom and top ply, to direct the cut-off weft thread around and possibly through the outer warp thread or warp threads. The lease function realizes the closing position for the end of the weft thread, when this emanates from that same ply of the top ply and bottom plies which comprises the turnover fold area on which the closing position is to be located.

The invention is not limited to the embodiment shown by way of example above, but can be subject to modifications within the scope of subsequent patent claims and the inventive concept.

What is claimed is:

1. Weaving machine apparatus for producing a tubular product including a top ply and a bottom ply and turnover fold areas in which warp and weft threads can be guided through sheds formed with the warp threads, the apparatus comprising:

a shaft frame weaving machine supplying a first lease function involving a first warp thread assembly and first warp threads;

at least one additional machine supplying a second lease function, coordinated with the first lease function, involving a second warp thread assembly, the at least one additional machine producing the turnover fold area spread in a longitudinal direction of the weft threads for cut-off weft threads;

cutting members, for cutting ends of the weft threads, arranged on a side of the at least one additional machine;

thread-end-controlling members arranged in the turnover fold area for guiding the cut weft thread ends to a position between two warp thread pairs which form a part of the second warp thread assembly, the warp thread pairs being chosen by a pattern controller of said additional machine to form a pattern of mutually displaced locations for exit positions in a spread direction of the turnover fold area.

2. The apparatus according to claim 1 wherein the at least one additional machine comprises a Jacquard machine supplying second warp threads, located outside the first warp threads, to form the second lease function and forming the pattern of the exit positions.

3. Weaving machine apparatus according to claim 1, wherein the thread-end-controlling members assign an exit position to a related weft thread end pair belonging to two cut-off weft threads and following each other in the pattern, said exit position being between same warp thread pairs or different warp thread pairs which are placed after each other in the longitudinal directions of the weft threads.

4. Weaving machine apparatus according to claim 1, wherein a part of the top ply which is woven by the additional machine forms a part of the turnover fold area and the thread-end-controlling members direct ends of weft threads belonging to the bottom ply so that the thread end turns back from an outer warp thread in the second warp thread assembly into the lease of the second lease function for the top ply to its exit position between warp thread pairs in the top ply.

5. Weaving machine apparatus according to claim 1, wherein part of the bottom ply woven by the additional machine forms a part of the turnover fold area and the thread-end-controlling members direct ends of weft threads belonging to the top ply so that the thread end turns back from an outer warp thread end in the second warp thread assembly into the lease of the second lease function for the bottom ply to its exit position between warp thread pairs in the bottom ply.

6. Weaving machine apparatus according to claim 1, wherein the thread-end-controlling members give the weft thread an even thread tension upon the introduction of the weft thread between its associated warp thread pair in the second warp thread assembly.

7. Weaving machine apparatus according to claim 6, wherein a gripper function is performed by the thread-end-controlling members to introduce a thread end belonging to the top or bottom ply in the second warp thread assembly in the lease for the second warp thread assembly to a particular warp thread pair therein.

8. Weaving machine apparatus according to claim 6, wherein a gripper function cooperates with a member of the thread-end-controlling members and comprises a gripper member which introduces a thread end belonging to the top or bottom ply in the second warp thread assembly in the lease for the second warp thread assembly to a particular warp pair therein.

9. Weaving machine apparatus according to claim 1, wherein the cutting members comprise gripper or pincers functions to cut off the weft thread at both its ends.

10. Weaving machine apparatus according to claim 1, wherein the additional machine operates at double repetition rate in relation to the shaft frame machine such that, in a first lease function for the first warp thread assembly, weft thread ends for weft threads in the top or bottom ply are introduced in the lease of the bottom and top ply, respectively, and, in a second lease function, in the top and bottom ply respectively, to enable coordination of the leasing of the shaft frame weaving machine.

11. A method of forming a tubular product including top and bottom plies formed from warp and weft threads, the method comprising:

piecing together the top and bottom plies with a turnover fold area, the turnover fold area being arranged in a longitudinal direction of the weft threads; and guiding a weft thread end with thread-end-controlling members from the bottom or top ply around an outer warp thread into a lease for the top and bottom ply, respectively, to an exit position between warp thread pairs in the turnover fold area.

12. Method for forming a tubular weave with a weaving machine arrangement, the tubular weave including top and bottom weave materials connected by turnover fold, the weave materials being woven by the weaving machine arrangement with first warp threads and weft threads, a weft thread being activated in a transverse direction of the warp threads through a shed and being cut off at its ends, the method comprising:

providing second warp threads, in connection with the first warp threads, with at least one additional machine;

actuating the second warp threads individually and separately in relation to the first warp threads with means for controlling the at least one additional machine;

forming at least one turnover fold area, which extends from an edge of the turnover fold area, from the second warp threads, the turnover fold extending in a direction of the weft threads; and arranging closing locations of the cut off ends in the turnover fold area to have spread positions.

13. Method according to claim 12, comprising providing two additional machines supplying third and fourth warp threads, respectively each additional machine being placed in connection with a side of the shaft frame weaving machine.

14. A weaving machine arrangement comprising:

a shaft frame weaving machine for weaving, with first warp threads, top and bottom weave materials which are joined by turnover fold areas, wherein weft threads are actuated in a direction transverse to the first warp threads through a shed formed by the first warp threads;

cutting members for cutting the weft threads at their ends;

at least one additional machine arranged beside the shaft frame weaving machine and providing second warp threads arranged outside the first warp threads, the at least one additional machine acts separately and individually upon the second warp threads in relation to the first warp threads to form sheds with the second warp threads for the weft threads and wherein the second warp threads form part of a turnover fold area extending in a longitudinal direction of the weft threads; and controlling means for controlling the at least one additional machine to provide different closing locations in the turnover fold area for thread ends.

15. Weaving machine according to claim 14, comprising one additional machine on each side of the warp threads of the shaft frame machine, the additional machines providing the second warp threads to form two turnover fold areas in the weave material which, in the pieced together state, form a tubular weave.

16. Weaving machine according to claim 14, wherein the additional machine comprises a pattern-weaving machine of the Jacquard machine type which forms a pattern of the closing locations of the weft threads in the turnover fold area.

17. Weaving machine according to claim 14, further comprising program-controlled equipment which randomly spreads out the closing locations in the turnover fold area in the longitudinal direction of the weft threads.

18. Weaving machine according to claim 14, wherein the additional machine operates with a number of bobbins which supports warp threads of different qualities, and each bobbin is assigned its own load cell for detection of warp thread tension.

19. A tubular weave comprising:

a top ply;

a bottom ply connected to the top ply by turnover fold areas, the top and bottom plies being formed from warp and weft threads arranged substantially perpendicular to each other;

exit positions for weft thread ends provided in the turnover fold area between pairs of warp threads, the exit positions being spread out in a longitudinal direction of the weft threads; and a first weft thread end of a first weft thread in the top or bottom ply and a second weft thread end of a second weft thread in the bottom or top ply, respectively, have a common exit position in the turnover fold area.

20. Tubular weave according to claim 19, wherein the turnover fold areas extend along parts of the top and bottom ply in the longitudinal direction of the weft threads, and the weft thread in the top or bottom ply, having its weft thread end applied in an exit position located in the turnover fold area of the bottom and top ply respectively, is guided around or through warp threads located outside its warp thread pair.

21. Tubular weave according to claim 19, wherein weft threads which were woven from the top or bottom ply to positions in the turnover fold area of the bottom and top ply, respectively, are drawn with tensile stresses which give even and uniform stretchings over outer warp threads.

22. In a shaft frame weaving machine in which top and bottom weave materials are formed using first warps threads and in which weft threads are drawn through sheds formed from the first warp threads, the improvement comprising:

a Jacquard machine supplying second warp threads located outside the first warp threads and comprising a lease supplementing a first lease of the shaft frame weaving machine to form a turn over fold area connecting the top and bottom weave materials and extending in a direction of the weft threads, the Jacquard machine also forming a pattern of closing location for ends of the weft threads; and a means for guiding the ends of the weft threads of the top or bottom weave material around an outer warp thread into the lease for the bottom or top weave material, respectively, and into closing positions in the bottom of the top weave material, respectively.

* * * * *